US006308418B1

(12) United States Patent
Sweet

(10) Patent No.: US 6,308,418 B1
(45) Date of Patent: Oct. 30, 2001

(54) UTILITY KNIFE

(76) Inventor: Gary B. Sweet, 230 Gulf St., Shrewsbury, MA (US) 01545

( * ) Notice: Subject to any disclaimer, the term of this patent is extended or adjusted under 35 U.S.C. 154(b) by 0 days.

(21) Appl. No.: 09/276,578

(22) Filed: Mar. 25, 1999

(51) Int. Cl.[7] ..... B26B 5/00
(52) U.S. Cl. ..... 30/136; 30/2; 30/169
(58) Field of Search ..... 30/2, 142, 143, 30/169, 151, 295, 152, 162, 335, 336; 15/236.01

(56) References Cited

U.S. PATENT DOCUMENTS

| | | | | |
|---|---|---|---|---|
| 3,171,201 | * | 3/1965 | Carifi | 30/162 X |
| 3,781,988 | | 1/1974 | Jones . | |
| 4,088,698 | | 5/1978 | Sparks . | |
| 4,091,537 | | 5/1978 | Stevenson, Jr. . | |
| 4,393,587 | | 7/1983 | Kloosterman . | |
| 4,675,996 | | 6/1987 | DuBuque . | |
| 4,757,612 | | 7/1988 | Peyrot . | |
| 5,093,994 | * | 3/1992 | Karas | 30/162 X |
| 5,613,300 | | 3/1997 | Schmidt . | |
| 5,617,635 | | 4/1997 | Berns . | |
| 5,794,347 | * | 8/1998 | Serpa | 30/162 |
| 5,924,203 | * | 7/1999 | Huang | 30/142 |

FOREIGN PATENT DOCUMENTS

| | | | | |
|---|---|---|---|---|
| 2612111 | * | 9/1988 | (FR) | 30/151 |

* cited by examiner

*Primary Examiner*—Douglas D. Watts
(74) *Attorney, Agent, or Firm*—O'Connell Law Firm

(57) ABSTRACT

A tool, such as a utility knife, comprising an elongate sheath, a longitudinally reciprocatable blade shield coupled to the elongate sheath, and a blade retainer with a retaining arm for being removably and replacably received in a channel within the elongate sheath. The blade shield comprises a side member, such as an elongate panel, for allowing a user to see at least a portion of a retained razor blade even while the blade shield is in an extended position. A displaced smooth bulbous segment may serve to widen and smooth the blade shield adjacent to a retained razor blade.

The blade retainer may be detachably fixed to the elongate sheath by at least a first locking leg with a locking protuberance that engages a corresponding first locking aperture. The blade retainer may be formed from a first blade retainer half and a second blade retainer half. Each blade retainer half may have a blade depression therein for retaining a razor blade. A scraper with a sharp edge may be operably associated with an exterior surface of the utility knife. The scraper may be extendible and retractable. The elongate sheath may be widened by an ergonomic ridge adjacent to an oblique engaging shoulder to increase the effective length of the oblique engaging shoulder.

23 Claims, 5 Drawing Sheets

UTILITY KNIFE

FIELD OF THE INVENTION

The present invention relates generally to tools. More particularly, the invention disclosed herein comprises a utility knife with a longitudinally reciprocatable blade shield and a readily removable blade retainer.

BACKGROUND OF THE INVENTION

With sharp edges designed for cutting, knives inherently present a danger of inadvertent cutting. This danger is particularly prevalent with utility knives where rapid and repeated cutting operations often are demanded. In such instances, the demanded speed or the monotony of repeated cutting operations may lead to a worker's not exercising a sufficient degree of care to maintain his or her own safety. For example, such a hurried or bored worker may use one hand to slice the razor blade quickly through a cardboard box or another article to be sliced, past the edge of the article, and into painful engagement with the worker's other hand, leg, or other body part Other problems often arise when a user employs a utility knife to perform a cutting operation and forgets to retract the device's razor blade. With this, a user swinging his or her arms while walking could inflict a painful gash to his or her own leg or to the body of another. Certainly, numerous other potential dangers resulting from an exposed razor blade will be obvious.

For many years, it was generally accepted that the dangers presented by utility knives were unavoidable. Advantageously, however, a plurality of inventors have made numerous attempts at making utility knives safer for normal use while compromising the knives' utility as little as possible. For example, the prior art reveals a utility knife with a pivotable, spring-biased guard that rotates from a blade-shielding position for protecting a user from the dangers of the razor blade to a blade-exposing position for allowing the performance of a cutting operation. Another utility knife provides an elongate safety guard that is disposed immediately adjacent to the cutting edge of the razor blade. The safety guard is longitudinally reciprocatable and is biased to an extended position such that it can retract to expose the razor blade to allow cutting and it can extend to shield the razor blade immediately after the utility knife is removed from the article being cut.

Unfortunately and notwithstanding the useful efforts of such previous inventors, utility knives continue to suffer from a plurality of disadvantages. For example, retractable blade shields in prior art devices normally shield both sides of a razor blade. With such shields, a user certainly enjoys some protection from the razor blade. However, the blade shield disadvantageously blocks the razor blade from a users sight. As a result, a user can forget or not notice that the razor blade is in an extended position whereby the very protection sought in providing the blade shield acts to endanger a user who might put the utility knife in the user's pocket or otherwise expose the user to danger from the unseen blade.

It must be recognized that utility knives have been disclosed with a blade shield disposed only on one side of a retained razor blade. These devices advantageously allow a user to view a retained razor blade even while the blade shield is in position protecting the user from the razor blade. However, such blade shields are known to be fixed relative to their respective utility knives. As a result, cutting with such utility knives requires that the razor blade be extended to a position beyond the blade shield or cutting operations with such a utility knife must be limited or specially adapted.

On a different note, one skilled in the art will be aware that in the most basic of utility knives, which is commonly referred to as a box cutter, replacing a razor blade comprises the relatively simple task of sliding a blade retainer from within a sheath, removing the dulled or broken blade from the blade retainer, inserting a blade with a sharp edge into the blade retainer, and sliding the blade retainer again into the sheath. Unfortunately, these box cutter utility knives can be among the most dangerous of utility knives. Not only is the razor blade completely unshielded when extended, but also the blade retainer is unrestrictedly slidable relative to the sheath whereby the razor blade can be extended unintentionally to present a most dangerous surprise.

Later-developed utility knives, for example those with shields or locking mechanisms, seek to cure one or more of the box cutter's drawbacks. In doing so, however, such knives have made it difficult or even impossible to replace spent razor blades. In many knives, a separate tool, such as a screwdriver, is required. Other knives are designed to be disposable, and they provide no means of replacing a spent razor blade. Such disposable knives often have elongate blades that are scored to allow a user to snap off distal sections of the blade when they become dull thereby to present a new, sharp section. Unfortunately, snapping sections from the blades of such knives presents a further danger from flying shards of worn metal.

In light of the foregoing, it becomes clear that a utility knife presenting a solution to one or more of the aforementioned deficiencies left by the prior art would be useful. However, it is dearer still that a utility knife presenting a solution to each and every one of the aforementioned problems while providing a number of heretofore unrealized advantages would represent a marked advance in the art.

SUMMARY OF THE INVENTION

Advantageously, the present invention is founded on the broadly-stated object of providing a utility knife that meets the needs that have been left unmet by the prior art. Stated more particularly, a principal object of the present invention is to provide a utility knife that is capable of shielding a razor blade with a reciprocatable shield in a manner that simultaneously allows a user to determine visually the position of the razor blade and, therefore, to appreciate the danger the utility knife presents. A further object of the invention is to provide a tool, such as a utility knife, that allows a user to separate constituent elements of the tool to enable, for example, a user to change razor blades expediently and safely. Another object of the instant invention is to provide a utility knife that presents an enlarged engaging shoulder disposed at an optimal angle for assisting a user in maintaining a consistent ideal, and safe cutting angle. A still further object of the invention is to provide a utility knife that is equally usable by left-handed and right-handed users. Yet another object of the invention is to provide a utility knife that, in addition to enabling a user to cut, also allows a user to scrape articles, such as stickers, from a given surface. Undoubtedly, these and further objects and advantages of the present invention will become obvious both to one who reviews the instant disclosure and to one who enjoys the opportunity to use an embodiment of the present invention.

In accomplishing the aforementioned objects, one preferred embodiment of the invention essentially comprises a tool in the form of a utility knife that comprises an elongate sheath with a body portion that has a proximal end and a distal end, a means for retaining a razor blade, and a blade shield reciprocatably coupled to the elongate sheath. The blade shield, which comprises a side member disposed adjacent to a first side of a retained razor blade, is longitudinally reciprocatable between a blade-shielding extended position for protecting a user and a blade-exposing retracted position for cutting. TAME blade shield may be biased to the blade-shielding extended position.

With this, the invention is extremely safe in use. One most basic reason is that the blade shield prevents inadvertent cutting with a retained razor blade because it is biased to shield the razor blade when not performing a cutting operation. The blade shield does so while uniquely allowing a user to see a retained razor blade even while the blade shield is in an extended position. As a result, a user will be far less likely than has been the case with prior art devices to be caught unaware by a razor blade that projects from the elongate sheath. It is noteworthy that, since the blade shield is readily reciprocatable to a blade-exposing retracted position, these advantages are achieved wile not diminishing from the knife's utility or convenience and without requiring an alteration of the cutting operation.

In particular embodiments, the side member of the blade shield may comprise an elongate panel. A distal end of the elongate panel may be disposed to be adjacent to a first side of a retained razor blade, and a first longitudinal edge of the elongate panel may be disposed to be adjacent to a razor edge of a retained razor blade. The utility knife may further comprise a blade retainer comprising a retaining arm that is removably and replacably received within a channel in the elongate sheath. In such a device, the means for retaining a razor blade may be disposed at a distal end of the retaining arm.

For enabling even better protection of a user, the distal end of the side member may comprise a projection that extends beyond the first longitudinal edge of the side member to present a widened portion of the blade shield that projects beyond a razor blade's edge in a direction parallel to a plane in which the razor blade is disposed. The projection may be a displaced smooth bulbous segment that initiates at the first longitudinal edge of the elongate panel, extends beyond the first longitudinal edge away from a second longitudinal edge, and then curves back to meet the second longitudinal edge. With this, the blade shield completely shields a razor blade to provide increased safety, and the blade shield presents a smooth surface for engaging an article to be cut to ensure that the utility knife can slide easily over an article to be cut and to ensure that the blade shield retracts readily.

In an exceedingly unique variation from the prior art, the utility knife may incorporate a means for detachably fixing the blade retainer relative to the elongate sheath. This may be accomplished, for example, by a first locking leg with a locking protuberance in combination with a first locking aperture and a second locking leg with a locking protuberance in combination with a second locking aperture wherein the locking protuberances of the first and second locking legs are disposed to engage respectively the first and second locking apertures when the retaining arm is received within the elongate sheath. Alternatively, the means for detachably fixing the blade retainer relative to the elongate sheath may comprise simply a first locking leg in combination with a first locking aperture. The locking leg or legs may be fixed to and project from the blade retainer and the locking aperture or apertures may be disposed on the elongate sheath. Alternatively, the locking leg or legs may be fixed to and project from the elongate sheath and the locking aperture or apertures may be disposed on the blade retainer. Still another variation could appropriately dispose a locking leg and a locking aperture on each of the blade retainer and the elongate sheath.

In a still further refinement, the blade retainer may further comprise a base. A proximal end of the retaining arm may be fixed to the base, and the locking leg or legs may project from the base. The utility knife may, but need not, further include a means for retaining spare razor blades on the retaining arm. The utility knife may, but need not, further include a scraper with a sharp edge that may be attached to an exterior surface of the utility knife. The scraper may be extendible to a position wherein the sharp edge of the scraper projects from the utility knife for allowing scraping and the scraper may be retractable to a position wherein the sharp edge of the scraper does not project from the utility knife. Alternatively, the scraper may be molded unitary with the utility knife. In any case, such a scraper would be particularly useful for removing stickers and tags and would avoid a user's needing to carry an additional tool for accomplishing such tasks.

A further nuance of the invention derives from the provision of an ergonomic ridge on the elongate sheath that may be disposed adjacent to the distal end thereof. Where the utility knife has an oblique engaging shoulder for engaging an article to be cut, the ergonomic ridge not only will enable a better, safer grip on the utility knife, but also the ergonomic ridge will cause the elongate sheath to be wider adjacent to the distal end of the elongate sheath which advantageously and uniquely will give the oblique engaging shoulder a length greater than a length that it would have absent the ergonomic ridge. With this, in addition to being easier and safer to grip and use, the utility knife provides a user with a greater surface upon which to guide the knife wile cutting thereby ensuring that the knife is disposed at a proper angle and that cutting proceeds smoothly.

With the invention summarily disclosed, one should remain mindful that the foregoing a discussion is designed merely to outline broadly the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of possible manifestations of the invention.

DETAILED DESCRIPTION OF A PREFERRED EMBODIMENT

To assist one in better understanding and, in appropriate circumstances, practicing the present invention, a preferred embodiment of the present invention for a utility knife is shown in the accompanying figures, which will be described with particularity below. Looking more particularly to FIG. 1, one will see an embodiment of the present invention for a utility knife indicated generally at 10. The utility knife 10 is formed from the union of first and second tool elements comprising an elongate sheath 12 and a blade retainer 14.

Figure 3:
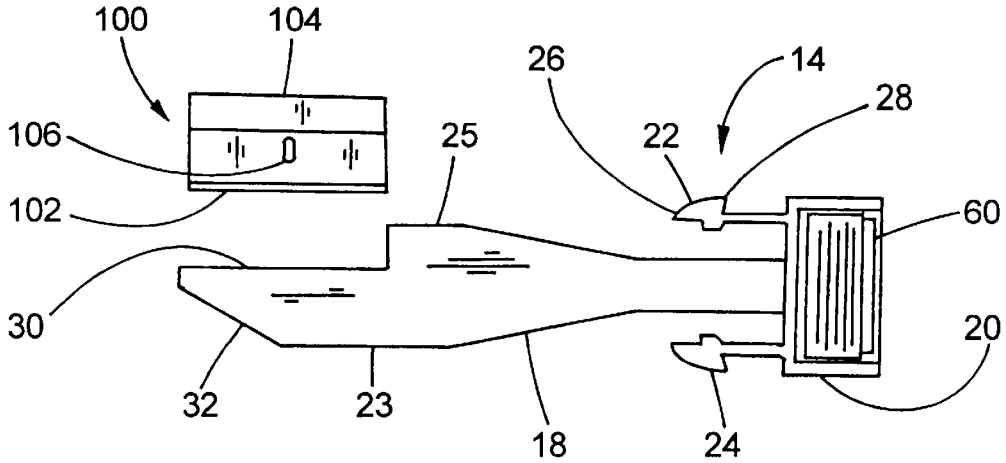
FIG. 3 is a view in side elevation of a blade retainer according to the present invention.

In FIG. 3, the blade retainer 14 is shown separated from the elongate sheath 12. The blade retainer 14 is founded on a rectangular base 20, which is disposed at what may be termed for convenience a proximal end of the blade retainer 14. From the base 20 projects a retaining arm 18 with a relatively narrow proximal end fixed to the base 20. Toward its distal end, the retaining arm 18 broadens to approximate the height of a standard razor blade 100, which is approximately 0.75 inches (1.9 cm.).

Figure 2:
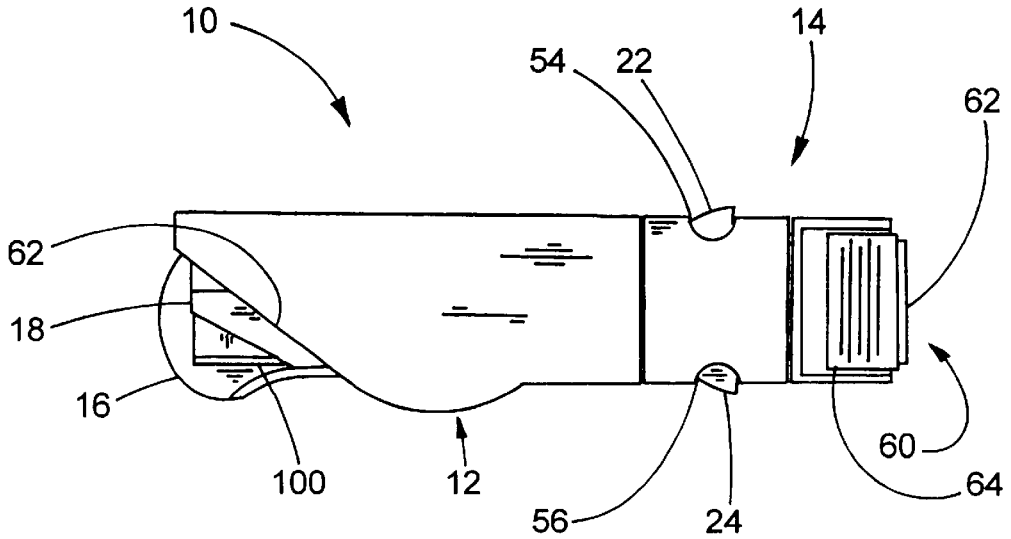
FIG. 2 is a view in side elevation of the utility knife of FIG. 1.
Figure 4:
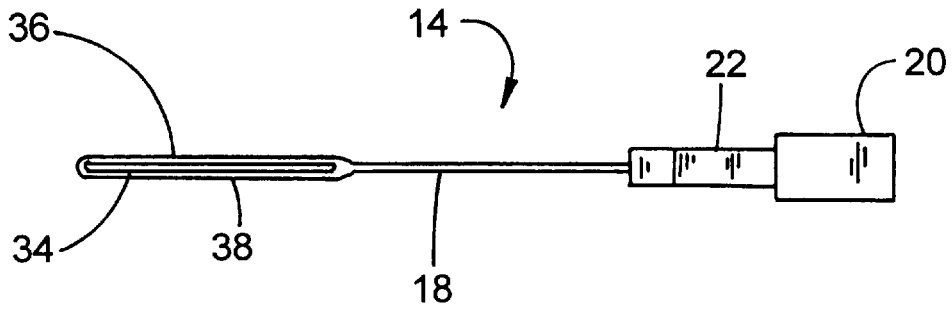
FIG. 4 is a top plan view of the blade retainer of FIG. 3.

As FIG. 4 shows, the distal end of the retaining arm 18 comprises a first wall 36 and a second wall 38 with a blade slot 34 disposed therebetween. The blade slot 34 is just slightly wider than a standard razor blade 100 is thick and is narrower than the band 104 of the razor blade 100 is wide. As FIG. 3 illustrates, a triangular cutout 32, which extends obliquely from a first longitudinal edge 23 of the retaining arm 18, is disposed adjacent to the distal end of the retaining arm 18. A rectangular cutout 30 is disposed adjacent to the distal end of the retaining arm 18 extending perpendicularly from a second longitudinal edge 25 thereof. The rectangular cutout 30 is approximately the size of a band 104 on a typical razor blade 100. With such an arrangement, a razor blade 100 can be slid into the blade slot 34 as can be seen in FIG. 2 so that a portion of an edge 102 of the razor blade 100 projects through the triangular cutout 32 and so that the band 104 of the razor blade 100 rests upon the periphery of the rectangular cutout 30.

One will note that in prior art utility knives (not shown) blade retaining elements commonly were formed from a single piece of flat metal that was folded back onto itself to form a sturdy member with a blade slot disposed therealong. Certainly, the retaining arm 18 of the present invention could be formed in such a manner. Of course, alternative structures are well within the scope of this invention. For example, the retaining arm 18 may be formed as a unitary member of molded plastic or the like.

The usefulness of the utility knife 10 is improved still further with the provision of an extendible and retractable scraper 60. As FIG. 2 shows, the scraper 60 comprises a sharp edge 62, which may comprise a metal scraper blade that is fixed to a carrier 64. The carrier 64 is reciprocatably coupled to the base 20. As a result, the scraper 60 can be disposed in an extended position as is shown in FIG. 2 where the sharp edge 62 projects from the utility knife 10, and the scraper 60 can be disposed in a retracted position as is shown in FIG. 3 where the sharp edge 62 does not project from the utility knife 10.

A first locking leg 22 and a second locking leg 24 each additionally project from the base 20 of the blade retainer 14 codirectionally with the retaining arm, with each of the first and second locking legs 22 and 24 comprising resilient members that are coupled at a proximal end to the base 20 such that they are flexible yet biased to the disposition shown in FIG. 3. A distal end of each of the first and second locking legs 22 and 24 comprises a sloped distal end 26 that leads to a locking protuberance 28. The function of these elements will be explained in more detail below.

Figure 5:
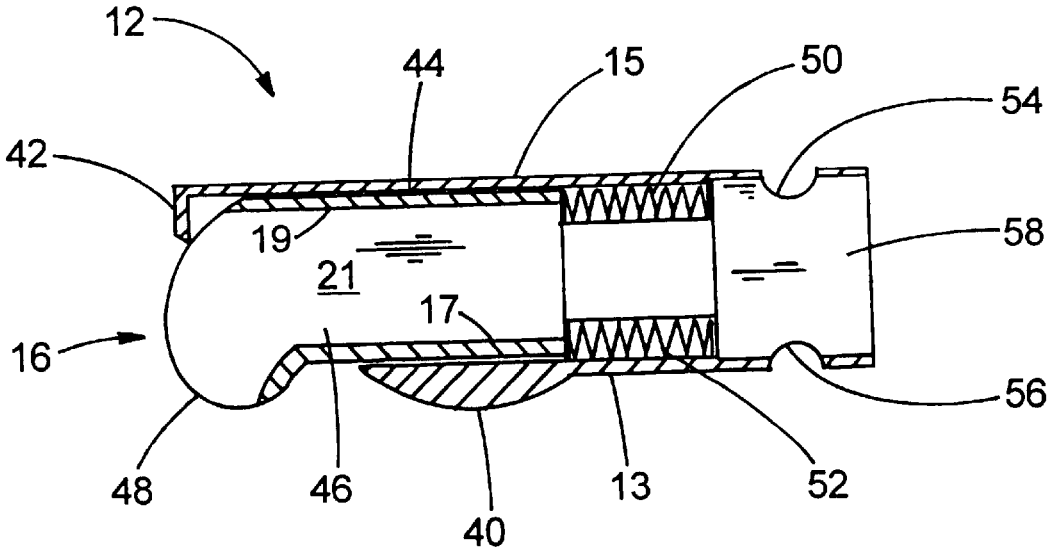
FIG. 5 is a sectional view in side elevation of an elongate sheath according to the present invention.

Looking to FIG. 5, which provides a sectional view of the elongate sheath 12, one sees the inner workings thereof. A proximal end of the elongate sheath 12 comprises a cavity 58 for receiing the first and second locking legs 22 and 24. The cavity 58 further receives therethrough the retaining arm 18. Considering the vertical dimension shown in FIGS. 2–5 to be a width dimension of the utility knife 10, the elongate sheath 12 is approximately as wide at its proximal end as is the base 20 of the blade retainer 14 such that the juncture between the blade retainer 14 and the elongate sheath 12 is smooth. Adjacent to the proximal end of the elongate sheath 12 are first and second locking apertures 54 and 56, the function of which will be explained in more detail below.

Figure 1:
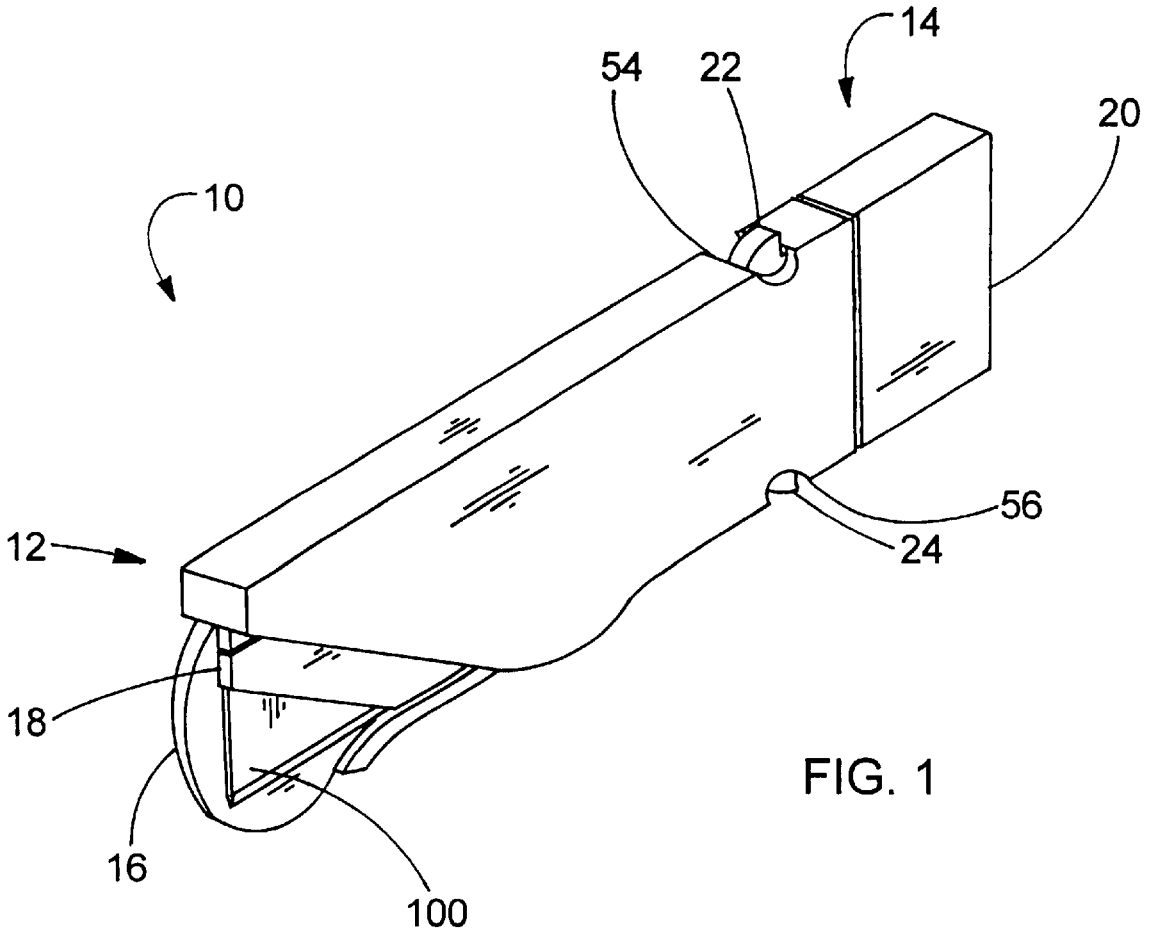
FIG. 1 is a perspective view of a utility knife embodying to the present invention.

A blade shield channel 44 communicates longitudinally along the body portion of the elongate sheath 12. The blade shield 16 is founded on an elongate panel 21. The elongate panel 21 maybe termed equally aptly a side member since it resides only to one side of a razor blade 100 that is retained by the retaining arm 18. Into the blade shield channel 44 is received a blade shield 16. The blade shield 16 is reciprocatably retained within the blade shield channel 44 for longitudinal reciprocation therealong. A first spring 50 and a second spring 52, each comprising a compression spring, are disposed also within the blade shield channel 44 exerting a biasing force on a proximal end of the blade shield 16 for biasing the blade shield 16 toward a blade-shielding extended position, which is shown in FIGS. 1, 2, and 5. Advantageously, the blade shield 16 is prevented from hyperextending by a restraining lip 42 that projects from a second longitudinal edge 15 of the elongate sheath 12.

The blade shield 16 itself has a first longitudinal edge 17 slidably disposed adjacent to a first longitudinal edge 13 of the elongate sheath 12, and the blade shield 16 has a second longitudinal edge 19 slidably disposed adjacent to the second longitudinal edge 15 of the elongate sheath. The blade shield 16 has a longitudinal retaining arm channel 46 disposed therealong for receiving the retaining arm 18. At a distal end of the blade shield 16 is disposed a projection comprising a smooth bulbous segment 48 that is displaced relative to the remainder of the blade shield 16. As FIG. 5 shows, the displaced smooth bulbous segment 48 initiates at the first longitudinal edge 17 of the blade shield 16, extends beyond the first longitudinal edge 17 away from the second longitudinal edge 19 of the blade shield 16, and then smoothly curves back to meet the second longitudinal edge 19. With this, the blade shield 16 completely shields a razor blade 100 and presents a smooth surface for engaging an article to be cut (not shown).

The astute observer will further note in FIG. 2 that the elongate sheath 12 is provided with an oblique engaging shoulder 62 at a distal end thereof for engaging an article to be cut. It is through this oblique engaging shoulder 62 that the blade shield 16 is biased to extend and through which the retaining arm 18 also extends when the elongate sheath 12 and the blade retainer 14 are matingly engaged. Advantageously, the elongate sheath 12 further comprises an ergonomic ridge 40 adjacent to the distal end of the elongate sheath 12 thereby widening the elongate sheath 12 adjacent to its distal end. As a consequence, the resulting utility knife 10 is much easier and safer to grip and handle because a users hand is less likely to slip toward the sharp razor blade 100 during cutting. Furthermore, the ergonomic ridge 40 causes the oblique engaging shoulder 62 to have a length greater than a length that it would have absent the ergonomic ridge 40. With this, a user is better able to maintain the utility knife 10 at a consistent and ideal cutting angle.

With the utility knife 10 disclosed, a method of using the utility knife 10 will be explained. This explanation will assume that the blade retainer 14 is received within the elongate sheath 12 without a razor blade 100 disposed in the distal end of the retaining arm 18. The user will first separate the elongate sheath 12 and the blade retainer 14. This will be accomplished in a most simple manner by simultaneously pressing on the sloped distal ends 26 of the flexible first and second locking legs 22 and 24, which are accessible through the first and second locking apertures 54 and 56, to press the locking protuberances 28 from within the first and second locking apertures 54 and 56 thereby allowing the blade retainer 14 to slide from within the elongate sheath 12. One will note that, since the first and second locking legs. 22 and 24 combine with the first and second locking apertures 54 and 56 to fix the elongate sheath 12 and the blade retainer 14 detachably together, one may aptly term the elements collectively a means for detachably fixing the blade retainer 14 relative to the elongate sheath 12.

With the distal end of the retaining arm 18 made accessible, a user can slip a razor blade 100 into the blade slot 34. With this done, the blade retainer 14 may be reinserted into the elongate sheath 12. As the blade retainer 14 is slid into the elongate sheath 12, the resilient first and second locking legs 22 and 24 will deflect as their sloped distal ends 26 engage the periphery of the cavity 58. Ultimately, the locking protuberances 28 will engage the first and second locking apertures 54 and 56 to fix the blade retainer 14 and the elongate sheath 12 relative to one another. With this, the utility knife 10 is thus equipped for cutting, as is shown in FIGS. 1 and 2. Advantageously, the razor blade 100 can be seen even as the blade shield 16 protects against inadvertent cutting.

To perform a cutting operation, a user can, for example, press the distal end of the utility knife 10 against a surface to be cut until the blade shield 16 sufficiently retracts to allow the razor blade 100 to engage an article to be cut (not shown). With this, the user will draw the razor blade 100 over the article to be cut thereby cutting that article a desired amount. Having done this, the user will remove the utility knife 10 from the article that has been cut whereupon the blade shield 16 will immediately spring back into its protective position.

Performing a scraping operation with the utility knife 10 is equally simple. A user would extend the carrier 64 of the scraper 60 to cause the sharp edge 62 to project beyond the utility knife 10. With this, scraping, for example, a label from a given article could be readily accomplished. Once a scraping operation is complete, a user need only retract the carrier 64 of the scraper 60 to cause the sharp edge 62 not to project from beyond the utility knife.

Figure 6:
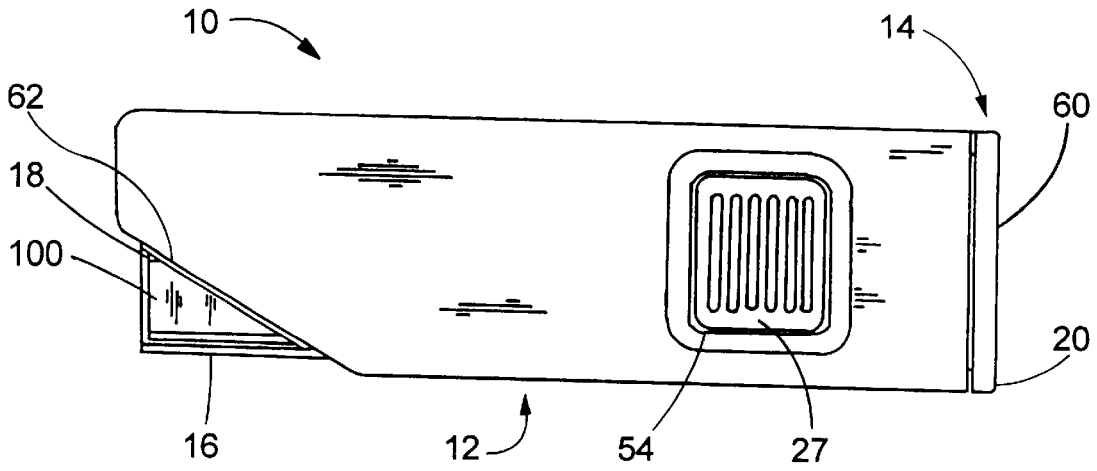
FIG. 6 is a view in side elevation of an alternative embodiment of the utility knife according to the present invention.

FIG. 6 shows an alternative embodiment of the utility knife 10. The utility knife 10 again has an elongate sheath 12 that matingly receives a blade retainer 14. A blade shield 16 again is reciprocatably biased to the blade shielding position shown in FIG. 6 for shielding a razor blade 100. In this embodiment, the blade shield 60 is biased by a single compression spring (not shown) as compared to the two compression springs 50 and 52 that were employed relative to the previous embodiment. Ideally, the elongate sheath 12 will be textured to provide better gripping ability. Alternatively or additionally, a plurality of ridges (not shown) may be provided on the elongate sheath 12 to enhance a user's gripping ability. A scraper 60 is again provided. Most simply and efficiently though, the scraper 60 in FIG. 6 comprises a sharp edge disposed on the base 20 of the blade retainer.

Figure 7:
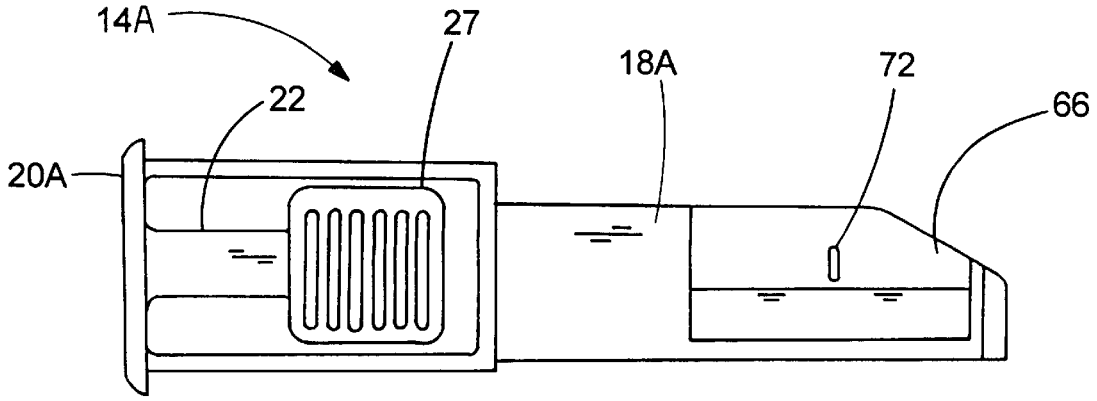
FIG. 7 is a view in side elevation of a first blade retainer half.
Figure 8:
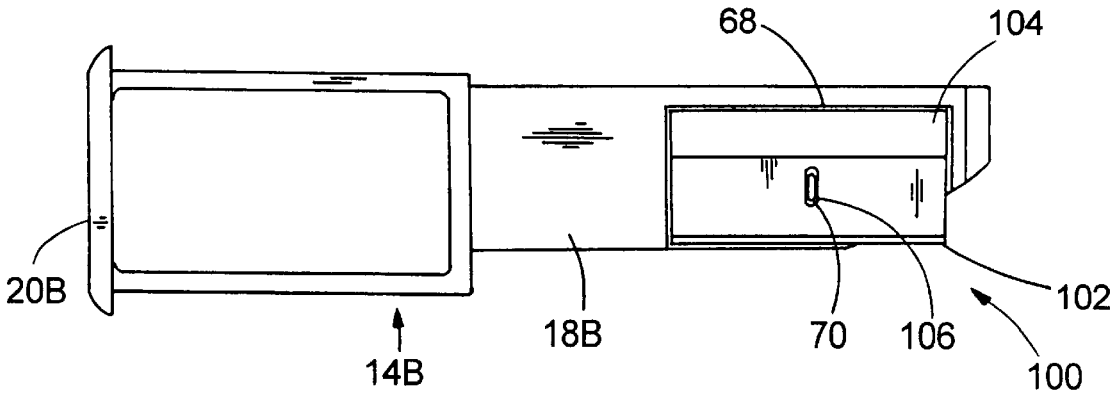
FIG. 8 is a view in side elevation of a second blade retainer half.

As can be seen best by combined reference to FIGS. 6, 7 and 8, the means for detachably fixing the blade retainer 14 relative to the elongate sheath 12 is simplified still further in this embodiment. From FIGS. 7 and 8, one sees that in this embodiment the blade retainer 14 is formed from a coupling of a first blade retainer half 14A with a second blade retainer half 14B. The first and second locking legs 22 and 24 are replaced on the first blade retainer half 14A by a single locking leg 22 of resilient material. In a similar manner, the first and second locking apertures 54 and 56 are replaced on the second blade retainer half 14B by a single locking aperture 54. The distal end of the locking leg 22 comprises a thumb pad 27. As is shown in FIG. 9, the thumb pad 27 projects outboard of the first blade retainer half 14A whereby the thumb pad 27 essentially functions as did the locking protuberance 28 in the previously-described embodiment.

One sees in FIG. 7 that the first blade retainer half 14A has a blade depression 66 formed therein adjacent to its distal end, and FIG. 8 shows that the second blade retainer half 14B has a blade depression 68 formed therein adjacent to its distal end. Each of the blade depressions 66 and 68 mirrors the outline and contour of a standard rectangular razor blade 100. Of course, the outline and contour of the blade depressions 66 and 68 could mirror other blade shapes such as a trapezoidal shape that is typical of another standard razor blade (not shown). Furthermore, it should be clear that there could be just a single blade depression 66 or 68 in either the first or second blade retainer half 14A or 14B with the blade retainer half 14A or 14B that does not have a blade depression 66 or 68 being flat. The blade depression 66 of the first blade retainer half 14A has a receiving aperture 72 disposed to align with and to receive a retaining projection 70 that projects from the blade depression 68 of the second blade retainer half 14B. The receiving aperture 72 and the retaining projection 70 each are disposed to align with a retaining aperture 106 that is typically disposed in a standard razor blade 100. With this, a razor blade 100 can be fixed in place between the first and second blade retainer halves 14A and 14B by the first and second blade depressions 66 and 68 and the cooperation of the retaining projection 70 and the receiving aperture 72.

Figure 9:
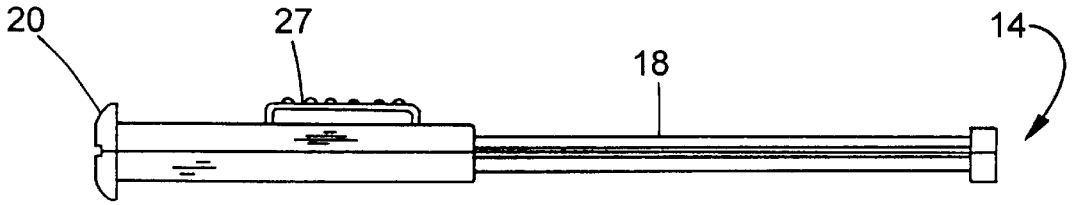
FIG. 9 is a top plan view of a blade retainer formed of the first blade retainer half and the second blade retainer half.

Under this arrangement, when the first blade retainer half 14A is coupled to the second blade retainer half 14B as is shown in FIG. 9, the unified blade retainer 14 can be slidably received into the elongate sheath 12 as is shown in FIG. 6. As the blade retainer 14 is slid into the elongate sheath 12, the thumb pad 27 and the locking leg 22 will deflect until the blade retainer 14 is fully received into the elongate sheath 12 whereupon the thumb pad 27 will snap into place in the locking aperture 54. With this, the blade retainer 14 will be locked in place relative to the elongate sheath 12 to form the complete utility knife 10 of FIG. 6. When necessary (i.e., for replacing a worn razor blade 100 or the like), the blade retainer 14 can be allowed to slide from within the elongate sheath 12 by a simple pressing of the thumb pad 27 to remove the thumb pad 27 from within the locking aperture 54.

From the foregoing, it will be apparent that the present invention provides a multiplicity of advantages over prior art utility knives. For example, the present utility knife 10 advantageously is capable of shielding a razor blade 100 with a reciprocatable blade shield 16 in a manner that protects a user from inadvertent cutting while simultaneously allowing a user to determine visually the position of the razor blade 100 and, therefore, to appreciate the danger the utility knife 10 presents. Furthermore, with the combination of the resilient locking legs 22 and 24 and the locking apertures 54 and 56 or the combination of the single locking leg 22 with the single locking aperture 54, the utility knife 10 allows for a simple and convenient separation of the elongate sheath 12 and the blade retainer 14, the constituent elements of the utility knife 10. With this, a user can change one razor blade 100 for another quickly and safely. Still further, with the ergonomic ridge 40 on the elongate sheath 12, the first embodiment of the utility knife 10 presents an enlarged engaging shoulder 62 that is disposed at an optimal angle for assisting a user in maintaining a consistent, ideal, and safe cutting angle. Even further advantage may be derived from the provision of the extendible and retractable scraper 60, which allows a user to scrape articles, such as stickers, from a given surface. Certainly, these and further advantages of the present invention will be obvious both to one who has reviewed the present disclosure and to one who enjoys an opportunity to use an embodiment of the present invention.

It will be clear that the present invention has been shown and described with reference to certain preferred embodiments that merely exemplify the broader invention revealed herein. Certainly, those skilled in the art can conceive of alternative embodiments. For instance, those with the major features of the invention in mind could craft embodiments that incorporate those major features wile not incorporating all of the features included in the preferred embodiments. With the foregoing in mind, the following claims are intended to define the scope of protection to be afforded the inventor, and the claims shall be deemed to include equivalent constructions insofar as they do not depart from the spirit and scope of the present invention.

It must be noted that a plurality of the following claims express certain elements as a means for performing a specific function, at times without the recital of structure or material. As the law demands, these claims shall be construed to cover not only the corresponding structure and material expressly described in the present specification but also equivalents thereof.

I claim as deserving the protection of United States Letters Patent:

1. A utility knife for use with a razor blade that has a first side, a second side, and a razor edge, the utility knife comprising:

an elongate sheath comprising a body portion with a proximal end, a distal end, and a channel therein;

a means for retaining a razor blade; and a blade shield reciprocatably associated with the elongate sheath and the means for retaining a razor blade wherein the blade shield is movable between a blade-shielding position for protecting a user and a blade-exposing position for cutting;

a blade retainer comprising a retaining arm that is removably and replacably received within the channel in the elongate sheath wherein the retaining arm has a proximal end and a distal end and wherein the means for retaining a razor blade is disposed at the distal end of the retaining arm wherein the blade retainer comprises a first blade retainer half and a second blade retainer half and wherein at least the first blade retainer half has a blade depression therein.

2. The utility knife of claim 1 further comprising a receiving aperture disposed on the first blade retainer half and a retaining projection disposed on the second blade retainer half to align with the receiving aperture wherein the receiving aperture and the retaining projection are mutually aligned to engage a retaining aperture on a razor blade to be retained.

3. The utility knife of claim 1 further comprising a means for detachably fixing the blade retainer relative to the elongate sheath.

4. A utility knife for use with a razor blade that has a first side, a second side, and a razor edge, the utility knife comprising:

an elongate sheath comprising a body portion with a proximal end, a distal end, and a channel therein;

a means for retaining a razor blade; and a blade shield movably associated with the elongate sheath and the means for retaining a razor blade wherein the blade shield is movable between a blade-shielding position for protecting a user and a blade-exposing position for cutting;

a blade retainer comprising a retaining arm that is removably and replacably received within the channel in the elongate sheath wherein the retaining arm has a proximal end and a distal end and wherein the means for retaining a razor blade is disposed at the distal end of the retaining arm;

a means for detachably fixing the blade retainer relative to the elonagate sheath comprising a first locking leg with a locking protuberance in combination with a first locking aperture wherein the locking protuberance of the first locking leg is disposed to engage the first locking aperture when the retaining arm is received within the channel of the elongate sheath.

5. The utility knife of claim 4 wherein the blade shield comprises a single-sided blade shield reciprocatably associated with the elongate sheath and the means for retaining a razor blade wherein the single-sided blade shield is longitudinally reciprocatable between a blade-shielding extended position for protecting a user and a blade-exposing retracted position for cutting and wherein the single-sided blade shield comprises a side member reciprocatably associated with the elongate sheath and the means for retaining a razor blade wherein the side member is disposed only adjacent to a first side of a razor blade when a razor blade is retained by the means for retaining a razor blade whereby a user can readily see at least a portion of a second side of a razor blade that is retained by the means for retaining a razor blade even while the single-sided blade shield is in an extended position.

6. The utility knife of claim 5 further comprising a means for biasing the single-sided blade shield to a blade-shielding position.

7. The utility knife of claim 5 wherein the side member of the single-sided blade shield comprises an elongate panel with a proximal end, a distal end, a first longitudinal edge, and a second longitudinal edge, wherein the distal end of the elongate panel is disposed to be adjacent to a fist side of a razor blade when a razor blade is retained by the means for retaining a razor blade, and wherein the first longitudinal edge is disposed to be adjacent to a razor edge of a razor blade when a razor blade is retained by the means for retaining a razor blade.

8. The utility knife of claim 7 wherein the distal end of the side member comprises a projection that extends beyond the first longitudinal edge of the side member to present a widened portion of the blade shield that projects beyond a razor edge of a razor blade when a razor blade is retained by the means for retaining a razor blade in a direction parallel to a plane in which the razor blade is disposed.

9. The utility knife of claim 8 wherein the projection of the first end portion of the side member comprises a displaced smooth bulbous segment wherein the bulbous segment initiates at the first longitudinal edge of the elongate panel, extends beyond the first longitudinal edge away from the second longitudinal edge, and then curves back to meet the second longitudinal edge whereby the single-sided blade shield completely shields a razor blade and presents a smooth surface for engaging an article to be cut.

10. The utility knife of claim 1 wherein the elongate sheath has a channel therein and further comprising a blade retainer comprising a retaining arm that is removably and replacably received within the channel in the elongate sheath wherein the retaining aim has a proximal end and a distal end and wherein the means for retaining a razor blade is disposed at the distal end of the retaining arm.

11. The utility knife of claim 10 wherein the first locking leg is fixed to and projects from the blade retainer and wherein the first locking aperture is disposed in the channel of the elongate sheath.

12. The utility knife of claim 10 wherein the means for detachably fixing the blade retainer to the elongate sheath further comprises a second locking leg with a locking protuberance in combination with a second locking aperture wherein the locking protuberance of the second locking leg is disposed to engage the second locking aperture when the retaining arm is received within the elongate sheath.

13. The utility knife of claim 12 wherein the first locking leg and the second locking leg are fixed to and project from the blade retainer and wherein the first locking aperture and the second locking aperture are disposed on the elongate sheath.

14. The utility knife of claim 11 wherein the blade retainer further comprises a base and wherein the proximal end of the retaining arm is fixed to the base and wherein the first locking leg projects from the base.

15. The utility knife of claim 1 further comprising a scraper comprising a sharp edge operably associated with an exterior surface of the utility knife.

16. The utility knife of claim 15 wherein the scraper is extendible to a position wherein the harp edge of the scraper projects from the utility knife for allowing scraping and wherein the scraper is retractable to a position wherein the sharp edge of the scraper does not project from the utility knife.

17. A utility knife for use with a razor blade that has a first side, a second side, and a razor edge, the utility knife comprising:

an elongate sheath comprising a body portion with a proximal end and a distal end;

a means for retaining a razor blade; and a single-sided blade shield reciprocatably associated with the elongate sheath and the means for retaining a razor blade wherein the single-sided blade shield is longitudinally reciprocatable between a blade-shielding extended position for protecting a user and a blade-exposing retracted position for cutting and wherein the single-sided blade shield comprises a side member reciprocatably associated with the elongate sheath and the means for retaining a razor blade wherein the side member is disposed only adjacent to a first side of a razor blade when a razor blade is retained by the means for retaining a razor blade whereby a user can readily see at least a portion of a second side of a razor blade that is retained by the means for retaining a razor blade even while the single-sided blade shield is in an extended position;

wherein the distal end of the elongate sheath comprises an oblique engaging shoulder for engaging an article to be cut and wherein the body portion further comprises an ergonomic ridge adjacent to the distal end of the elongate sheath whereby the elongate sheath is wider adjacent to the distal end of the elongate sheath and whereby the oblique engaging shoulder has a length greater than a length that it would have absent the ergonomic ridge.

18. A utility knife comprising:

a first tool element comprising a blade retainer;

a means for removably and replacably retaining a razor blade relative to the blade retainer;

a second tool element for engaging with the first tool element wherein the second tool element comprises an elongate sheath with a channel therein for slidably receiving at least a portion of the blade retainer;

a first locking lea attached to the blade retainer wherein the first locking leg has a locking protuberance thereon; and a first locking aperture disposed on the elongate sheath for engaging the locking protuberance of the first locking leg;

wherein the locking protuberance of the first locking leg is disposed to engage the first locking aperture when the blade retainer is engaged with the elongate sheath;

wherein at least a portion of the blade retainer can be slidably received within the channel in the elongate sheath and locked in place therewithin by an engagement of the locking protuberance of the first locking leg of the blade retainer with the first locking aperture of the elongate sheath and wherein the locking protuberance of the first locking leg can be disengaged from the first locking aperture of the elongate sheath to allow the blade retainer to be slid entirely from within and separated from the elongate sheath;

whereby the blade retainer can be readily slid entirely from within and separated from the elongate sheath by a disengagement of the locking protuberance of the first locking leg from the first locking aperture of the elongate sheath to allow for a removal and replacement of a razor blade that is retained by the means for removably retaining a razor blade relative to the blade retainer; and a second locking leg attached to the blade retainer tool wherein the second locking leg has a locking protuberance and further comprising a second locking aperture disposed on the elongate sheath, wherein the locking protuberance of the second locking leg is disposed to engage the second locking aperture when the blade retainer is engaged with the elongate sheath.

19. The utility knife of claim 18 wherein the blade retainer comprises a base and a retaining arm and wherein the proximal end of the retaining arm is fixed to the base and wherein the first locking leg projects from the base.

20. A utility knife comprising:

a first tool element comprising a blade retainer;

a means for removably and replacably retaining a razor blade relative to the blade retainer;

a second tool element for engaging with the first tool element wherein the second tool element comprises an elongate sheath with a channel therein for slidably receiving at least a portion of the blade retainer;

a first locking leg attached to the blade retainer wherein the first locking leg has a locking protuberance thereon; and a first locking aperture disposed on the elongate sheath for engaging the locking protuberance of the first locking leg;

wherein the locking protuberance of the first locking leg is disposed to engage the first locking aperture when the blade retainer is engaged with the elongate sheath;

wherein at least a portion of the blade retainer can be slidably received within the channel in the elongate sheath and locked in place therewithin by an engagement of the locking protuberance of the first locking leg of the blade retainer with the first locking aperture of the elongate sheath and wherein the locking protuberance of the first locking leg can be disengaged from the first locking aperture of the elongate sheath to allow the blade retainer to be slid entirely from within and separated from the elongate sheath;

whereby the blade retainer can be readily slid entirely from within and separated from the elongate sheath by a disengagement of the locking protuberance of the first locking leg from the first locking aperture of the elongate sheath to allow for a removal and replacement of a razor blade that is retained by the means for removably retaining a razor blade relative to the blade retainer;

wherein the blade retainer comprises a first blade retainer half and a second blade retainer half and wherein at least the first blade retainer half has a blade depression therein.

21. The utility knife of claim 20 further comprising a receiving aperture disposed on the first blade retainer half and a retaining projection disposed on the second blade retainer half to align with the receiving aperture wherein the receiving aperture and the retaining projection are mutually aligned to engage a retaining aperture on a razor blade to be retained.

22. A utility knife comprising:

a first tool element comprising a blade retainer;

a means for removably and replacably retaining a razor blade relative to the blade retainer;

a second tool element for engaging with the first tool element wherein the second tool element comprises an elongate sheath with a channel therein for slidably receiving at least a portion of the blade retainer;

a first locking leg attached to the blade retainer wherein the first locking leg has a locking protuberance thereon; and a first locking aperture disposed on the elongate sheath for engaging the locking protuberance of the first locking leg;

wherein the locking protuberance of the first locking leg is disposed to engage the first locking aperture when the blade retainer is engaged with the elongate sheath;

wherein at least a portion of the blade retainer can be slidably received within the channel in the elongate sheath and locked in place therewithin by an engagement of the locking protuberance of the first locking leg of the blade retainer with the first locking aperture of the elongate sheath and wherein the locking protuberance of the first locking leg can be disengaged from the first locking aperture of the elongate sheath to allow the blade retainer to be slid entirely from within and separated from the elongate sheath;

whereby the blade retainer can be readily slid entirely from within and separated from the elongate sheath by a disengagement of the locking protuberance of the first locking leg from the first locking aperture of the elongate sheath to allow for a removal and replacement of a razor blade that is retained by the means for removably retaining a razor blade relative to the blade retainer; and a scraper comprising a sharp edge operably associated with an exterior surface of the utility knife wherein the scraper is extendible to a position wherein the sharp edge of the scraper projects from the utility knife for allowing scraping and wherein the scraper is retractable to a position wherein the sharp edge of the scraper does not project from the utility knife.

23. A utility knife comprising:

a first tool element comprising a blade retainer;

a means for removably and replacably retaining a razor blade relative to the blade retainer;

a second tool element for engaging with the first tool element wherein the second tool element comprises an elongate sheath with a channel therein for slidably receiving at least a portion of the blade retainer;

a first locking leg attached to the blade retainer wherein the first locking leg has a locking protuberance thereon; and a first locking aperture disposed on the elongate sheath for engaging the locking protuberance of the first locking leg;

wherein the locking protuberance of the first locking leg is disposed to engage the first locking aperture when the blade retainer is engaged with the elongate sheath;

wherein at least a portion of the blade retainer can be slidably received within the channel in the elongate sheath and locked in place therewithin by an engagement of the locking protuberance of the first locking leg of the blade retainer with the first locking aperture of the elongate sheath and wherein the locking protuberance of the first locking leg can be disengaged from the first locking aperture of the elongate sheath to allow the blade retainer to be slid entirely from within and separated from the elongate sheath;

whereby the blade retainer can be readily slid entirely from within and separated from the elongate sheath by a disengagement of the locking protuberance of the first locking leg from the first locking aperture of the elongate sheath to allow for a removal and replacement of a razor blade that is retained by the means for removably retaining a razor blade relative to the blade retainer;

wherein the elongate sheath comprises a body portion with a proximal end and a distal end wherein the distal end of the elongate sheath comprises an oblique engaging shoulder for engaging an article to be cut and wherein the body portion further comprises an ergonomic ridge adjacent to the distal end of the elongate sheath whereby the elongate sheath is wider adjacent to the distal end of the elongate sheath and whereby the oblique engaging shoulder has a length greater than a length that it would have absent the ergonomic ridge.

* * * * *